US006764172B1

(12) United States Patent
Hsu et al.

(10) Patent No.: US 6,764,172 B1
(45) Date of Patent: Jul. 20, 2004

(54) AIR BAG PLACED IN A PRINT CARTRIDGE AND METHOD FOR MANUFACTURING THE SAME

(75) Inventors: Cheng-Wei Hsu, Yung Kang (TW); Bo-Hsiang Wang, Tai Ping (TW)

(73) Assignee: International United Technology Co., Ltd., Hsin-Chu (TW)

( * ) Notice: Subject to any disclaimer, the term of this patent is extended or adjusted under 35 U.S.C. 154(b) by 0 days.

(21) Appl. No.: 10/341,439

(22) Filed: Jan. 14, 2003

(51) Int. Cl.[7] ..... B41J 2/175
(52) U.S. Cl. ..... 347/86
(58) Field of Search ..... 347/86, 87, 85; 222/92, 105, 527

(56) References Cited

U.S. PATENT DOCUMENTS 5,537,134 A * 7/1996 Baldwin et al. ..... 347/85
5,975,686 A * 11/1999 Hauck et al. ..... 347/85
5,988,803 A * 11/1999 Komplin et al. ..... 347/86
6,067,906 A * 5/2000 Ryan et al. ..... 101/335
6,145,973 A * 11/2000 Wu et al. ..... 347/86
6,213,598 B1 * 4/2001 Hou et al. ..... 347/86

* cited by examiner

*Primary Examiner*—Anh T.N. Vo
(74) *Attorney, Agent, or Firm*—Browdy and Neimark, P.L.L.C.

(57) ABSTRACT

An air bag placed in a print cartridge and a method for manufacturing the same are provided, wherein a layered material with two faces of different ingredients are utilized. After cutting and opening of connection holes and air vent holes, flexible stacking according to the capacity requirement of the air bag and thermal pressuring are performed. Through the characteristic that two low-melting-point ingredients can be affixed together but two high-melting-point ingredients or a low-melting-point ingredient and a high-melting-point ingredient cannot be affixed together, the whole air bag can be integrally formed. The air bag forms a plurality of receiving rooms having connected air vent holes. The air bag can be folded up to make inflation and deflation, hence filling up the ink-storage capacity of the print cartridge. Moreover, the back pressure can be adjusted.

20 Claims, 8 Drawing Sheets

AIR BAG PLACED IN A PRINT CARTRIDGE AND METHOD FOR MANUFACTURING THE SAME

FIELD OF THE INVENTION

The present invention relates to an air bag placed in a print cartridge and a method for manufacturing the same and, more particularly, to a folding type air bag and a method for manufacturing the same, which applies to a print cartridge of an inkjet printer to fill its volume and adjust its back pressure.

BACKGROUND OF THE INVENTION

Printers are the primary data output devices among computer peripherals. Recently, inkjet printers have been developed to have a high-quality printing effect and a low cost so as to become standard equipments of computer. One characteristic of an inkjet printer is its diversified variation of colors. In the design of a print cartridge including inks of various kinds of colors, the ink-out smoothness and the consuming rate of ink are taken into serious consideration.

A print cartridge comprises an ink reservoir and a printing head. When not in use, in order to avoid stains or blocking of the printing head, a back pressure is usually added in the ink reservoir. That is, when the ink-storage capacity in the ink reservoir decreases, the back pressure rises to prevent leakage of ink. When the exterior pressure decreases (e.g. during transportation high up in the air), it is necessary to keep an appropriate back pressure in the ink reservoir. When ink gradually goes out for printing, the back pressure will rise along with decrease of ink. Once the back pressure exceeds the range of the ink-out pressure of the printing head (i.e. the back pressure is larger than the ink-out pressure required for printing texts and pictures), smooth ink-out actions for printing will no longer be feasible. When ink gradually runs out, rise of the back pressure will also let normal ink-out actions for printing be unfeasible, hence wasting residual ink in the partial cartridge.

U.S. Pat. No. 5,526,030 disclosed a pressure control device. As shown in FIG. 1, a bubble generator 25*a* is disposed in an ink reservoir 15*a* of a print cartridge 1*a*. The bubble generator 25*a* has a pipe 26*a* connected with exterior air. A ball 27*a* is disposed in the pipe 26*a*. A gap (not shown) is disposed at the contact portion of the pipe 26*a* and the ball 27*a*. A liquid seal is formed by the capillary phenomenon to isolate the ink reservoir 15*a* from exterior air. Simultaneously, the generated bubble enters into the ink reservoir timely. When ink goes out for printing, the back pressure of the ink reservoir 15*a* will start to rise. When the exterior pressure is larger than the pressure of the liquid seal, the bubble will enter into the ink reservoir 15*a* to lower the back pressure in the ink reservoir 15*a*. A liquid seal immediately forms by the capillary phenomenon to isolate the ink reservoir 15*a* from exterior air again. Generation of bubbles of the bubble generator 25*a* depends on the surface tension of ink and the design of the gap's size. Therefore, the design of the bubble generator 25*a* differs according to different inks. The pipe 26*a* needs to be located in the ink to truly exploit the bubble-generating function. Once the exterior pressure decreases, leakage of ink cannot be avoided.

R.O.C. Pat. No. 438,684 disclosed another pressure control device. As shown in FIG. 2, a print cartridge 1*a* comprises an upper portion 11*a*, a first sidewall 12*a*, a second sidewall 13*a*, and a bottom portion 14*a*, which form an ink reservoir 15*a*. A pressure adjuster 28*a* and a bubble generator 25*a* are disposed in the ink reservoir 15*a*. The pressure adjuster 28*a* has an air bag 10*a*, a pressing plate 21*a*, and a spring 20*a*. The air bag 10*a* has a first receiving room 33*a* and a second receiving room 34*a*. The pressing plate 21*a* has a first surface 22*a* and a second surface 23*a*. One end of the spring 20*a* is connected to the first sidewall 12*a* of the print cartridge 12*a*, and the other end thereof is connected to the first surface 22*a* of the pressing plate 21*a*. An outside of the first receiving room 33*a* contacts the second surface 23*a* of the pressing plate 21*a*. An air vent hole 32*a* for free flow of air is disposed between the first receiving room 33*a* and the second receiving room 34*a*. An outside of the second receiving room 34*a* contacts the second sidewall 13*a* of the print cartridge 1*a*. The second receiving room 34*a* has a guide pipe 24*a* connected to the upper portion 11*a* of the print cartridge 1*a* to communicate with exterior air. The bubble generator 25*a* is disposed at the bottom portion 14*a* of the print cartridge 1*a*. The bubble generator 25*a* comprises a pipe 26*a*, a ball 27*a*, and an elastic component 29*a*. The pipe 26*a* is disposed at the bottom portion 14*a* of the print cartridge 1*a* to communicate with exterior air. The ball 27*a* is disposed at the top of the pipe 26*a* to prevent air from entering into the ink reservoir 15*a*. The elastic component 29*a* is fixed at the bottom portion 14*a* of the print cartridge 1*a*, and has a first portion 30*a* and a second portion 31*a*. The first portion 30*a* contacts the ball 27*a*. The second portion 31*a* contacts the first surface 22*a* of the pressing plate 21*a* of the pressure adjuster 28*a*. A printing head 19*a* is disposed at the bottom portion 14*a* of the print cartridge 1*a*. When the back pressure rises, the air bag 10*a* of the pressure adjuster 28*a* inflates a let the pressing plate 21*a* push the second portion 31*a* of the elastic component 29*a*. The first portion 30*a* of the elastic component 29*a* will thus leaves from the ball 27*a* to lift the ball 27*a* so that exterior air can either into the ink reservoir 15*a*. A bubble can thus be generated to enter into the ink reservoir 15*a*, hence lowering the back pressure. After the back pressure decreases, the spring 20*a* will exert a force onto the pressing plate 21*a* to deflate the air bag 10*a* so as to restore the elastic component 29*a*. The ball 27*a* will again prevent air from entering into the ink reservoir 15*a*. Therefore, keeping of the back pressure will not be affected by the surface tension formed by different kinds and properties of ink. Moreover, it is not necessary to precisely design the size of the pipe 26*a*. However, the design and manufacturing of the air bag 10*a* of the pressure adjuster 28*a* limits the ink-storage capacity, hence not meeting the requirement of full usage of ink. Moreover, due to creases formed by retractile actions of the air bag 10*a*, the effect of the air bag 10*a* inflating repetitively and the functions of other devices disposed in the ink reservoir 15*a* will be influenced.

Accordingly, the design of the conventional print cartridge has inconvenience and drawbacks in practical manufacturing and use. The present invention aims to resolve the problems in the prior art.

SUMMARY OF THE INVENTION

The primary object of the present invention is to provide an air bag placed in a print cartridge and a method for manufacturing the same, whereby the air bag can fill the ink-storage capacity in the print cartridge so that ink can be used up completely.

Another object of the present invention is to provide an air bag placed in a print cartridge and a method for manufacturing the same, whereby the manufacturing process of the air bag can be simplified and sped up.

Another object of the present invention is to provide an air bag placed in a print cartridge and a method for manufacturing the same, whereby the proceeding direction of the air bag can be easily controlled.

Another object of the present invention is to provide an air bag placed in a print cartridge and a method for manufacturing the same, whereby creases will not be generated when the air bag inflates and then deflates, and the functions of other devices in the print cartridge will not be easily influenced after the air bag inflates again.

To achieve the above objects, the present invention provides an air bag placed in a print cartridge and a method for manufacturing the same. The method comprises the following steps.

(1) A layered material having double faces of different ingredients is provided;

(2) A side membrane is placed with a high-melting-point ingredient facing downwards and a low-melting-point ingredient facing upwards;

(3) A connection membrane is placed with the high-melting-point ingredient facing downwards and the low-melting-point ingredient facing upwards;

(4) A folding membrane is placed with the low-melting-point ingredient facing downwards and the high-melting-point ingredient facing upwards;

(5) A folding membrane is placed with the high-melting-point ingredient facing downwards and the low-melting-point ingredient facing upwards;

(6) A connection membrane is placed with the low-melting-point ingredient facing downwards and the high-melting-point ingredient facing upwards;

(7) A side membrane is placed with the low-melting-point ingredient facing downwards and the high-melting-point ingredient facing upwards;

(8) Thermal pressure is performed to integrally from the whole air bag.

The present invention provides an air bag placed in a print cartridge. The print cartridge comprises an upper portion, a first sidewall, a second sidewall, and a bottom portion, which form an ink reservoir. The upper portion has an ink-filling hole and an air vent. The ink-filling hole has a plug. The bottom portion has a printing head. Ink is received in the ink reservoir. The air bag comprises side membranes whose one face adhering a low-melting-point ingredient and whose other face adhering a high-melting-point ingredient; folding membranes whose one facing adhering the low-melting-point ingredient and whose other face adhering the high-melting-point ingredient, and connection membrane whose one face adhering the low-melting-point ingredient and whose other face adhering the high-melting-point ingredient. The peripheral size of the folding membrane corresponds to that of the side membrane. A connection hole is opened at the folding membrane. The peripheral size of the connection membrane is larger than the size of the connection hole of the folding membrane. An air vent hole is opened at the connection membrane. The size of the air vent hole is smaller than that of the connection hole of the folding membrane. The periphery of the low-melting-point ingredient of the side membrane connects the periphery of the low-melting-point ingredient of the folding membrane to form a first receiving room and a last receiving room. The peripheries of the low-melting-point ingredient of two folding membranes are connected together. The periphery of the low-melting-point ingredient of the connection hole of the folding membrane connects the periphery of the low-melting-point ingredient of the connection membrane. The peripheries of the low-melting-point ingredient of the air vent holes of two folding membranes are connected together to form other receiving rooms having connected air vent holes. A folding air bag capable of inflating and deflating is thus formed. Ink can be received in the air bag. The ink reservoir forms an air-storage capacity (i.e. an air tank), while the air bag forms an ink-storage capacity (i.e. an ink-storage bag).

The various objects and advantages of the present invention will be more readily understood from the following detailed description when read in conjunction with the appended drawing, in which:

DETAILED DESCRIPTION OF THE PREFERRED EMBODIMENTS

Figure 1:
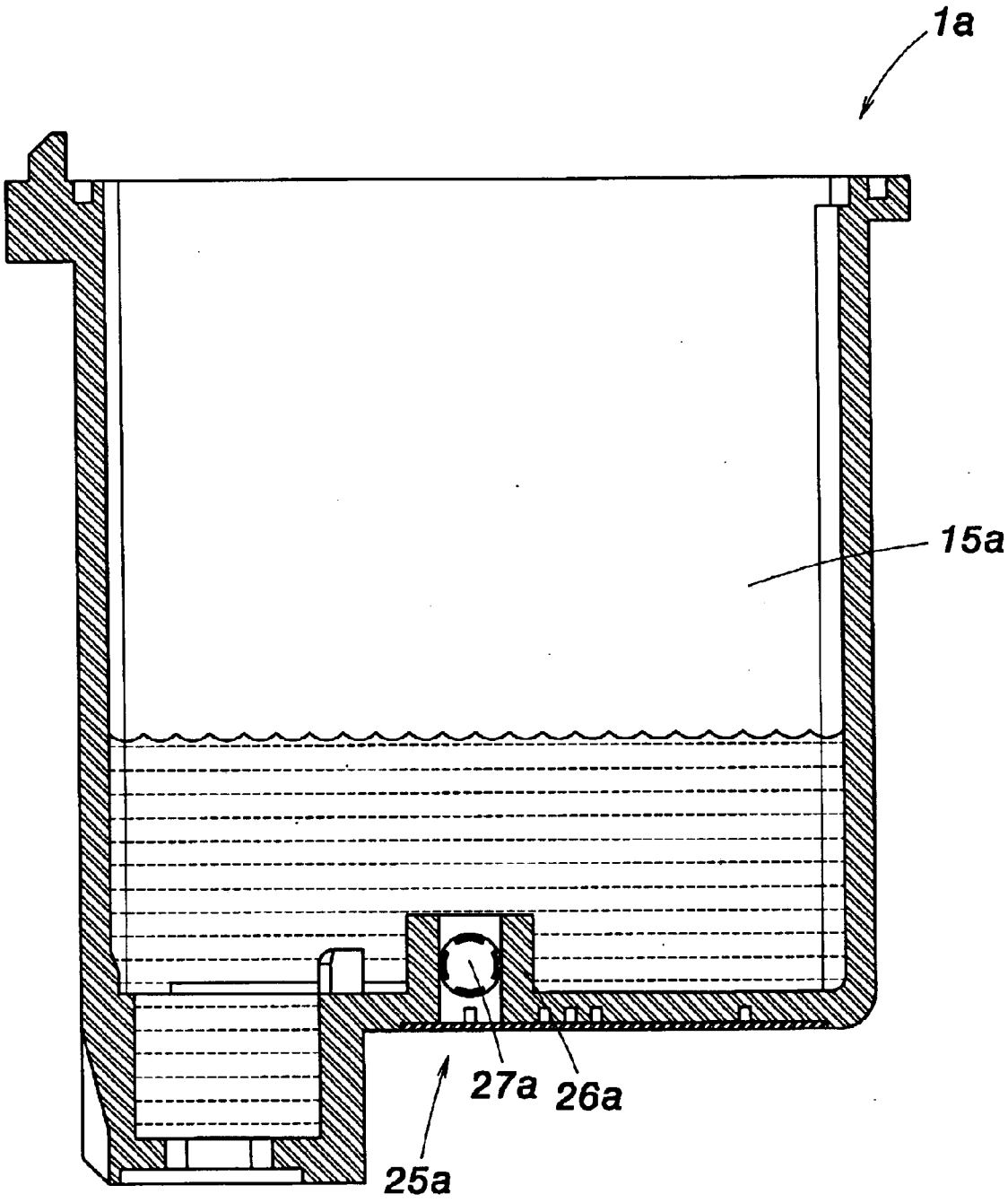
FIG. 1 PRIOR ART
FIG. 1 is a side cross-sectional view of a conventional print cartridge.
Figure 2:
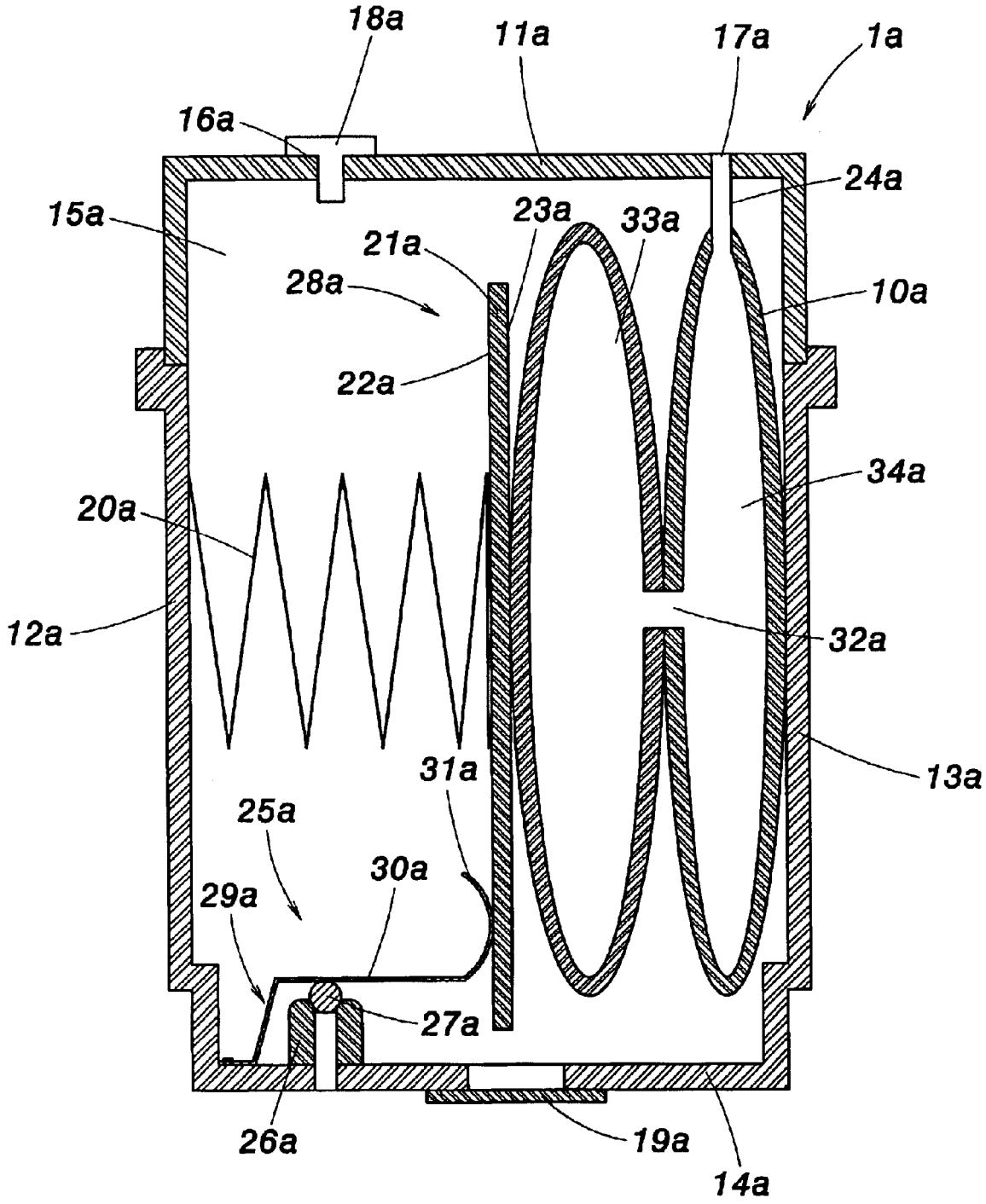
FIG. 2 PRIOR ART
FIG. 2 is a side cross-sectional view of another conventional print cartridge.
Figure 3:
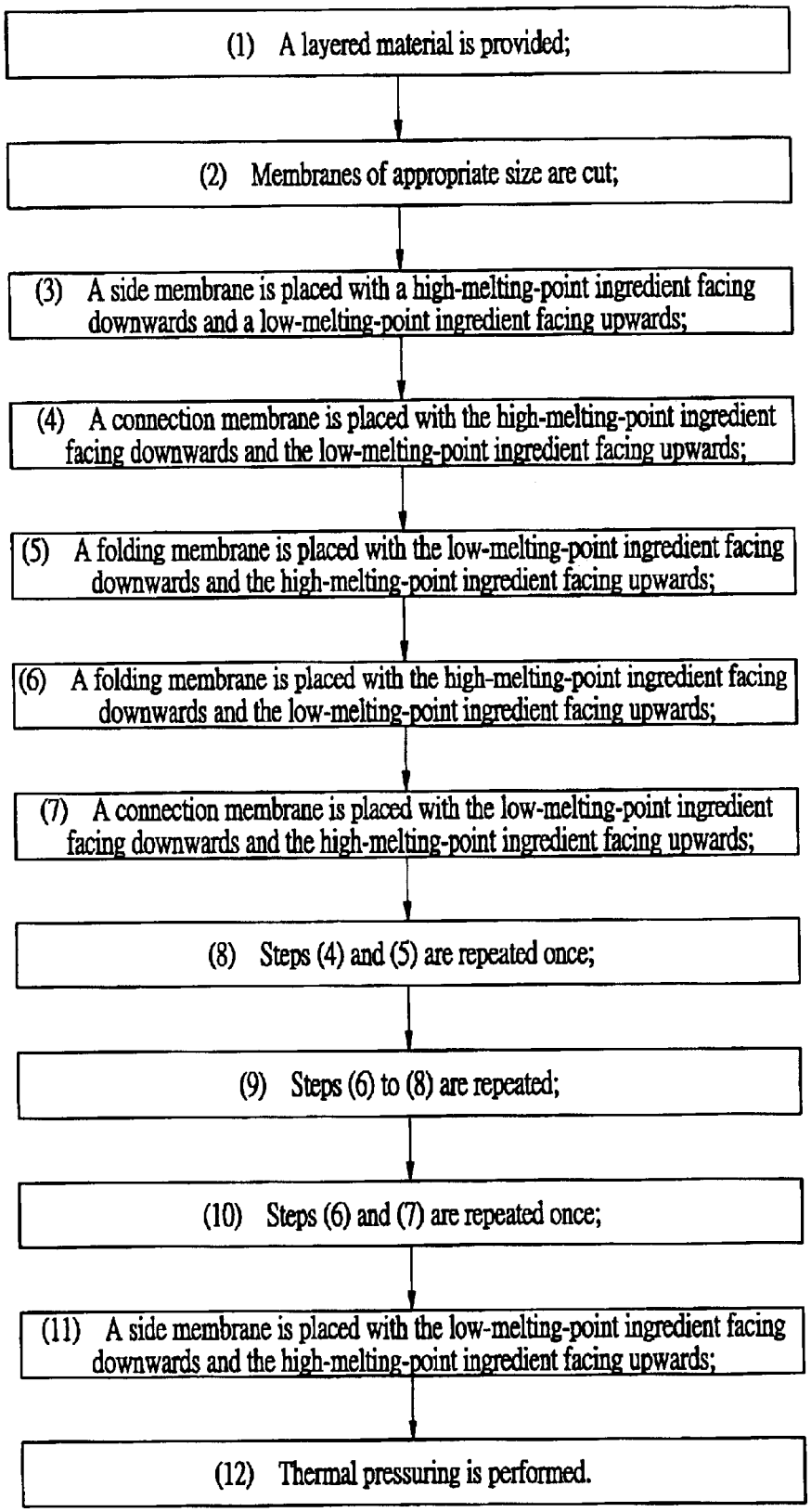
FIG. 3 is a flowchart of the manufacturing method of the present invention.
Figure 4:
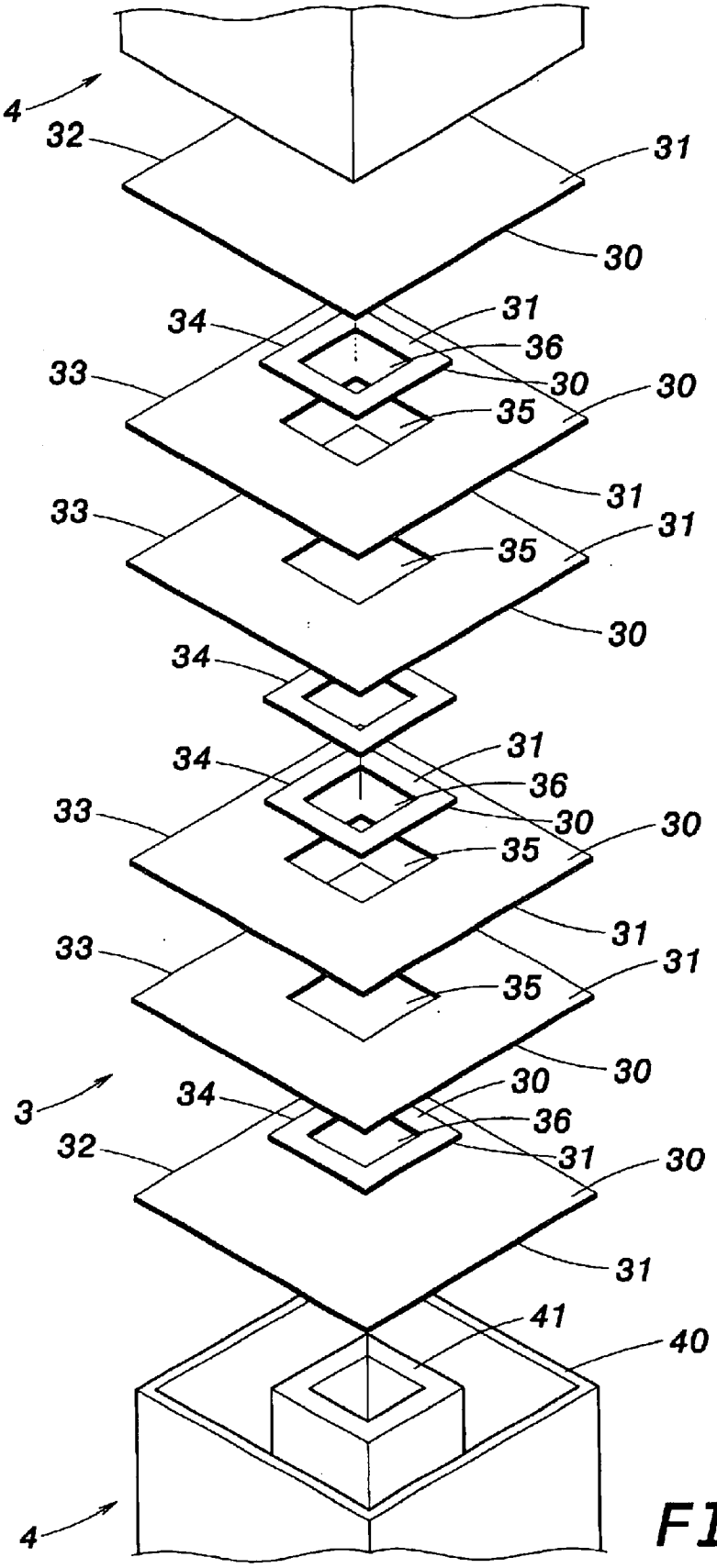
FIG. 4 is a perspective view showing air bags the present invention are arranged in order and integrally formed by thermal pressuring.
Figure 5:
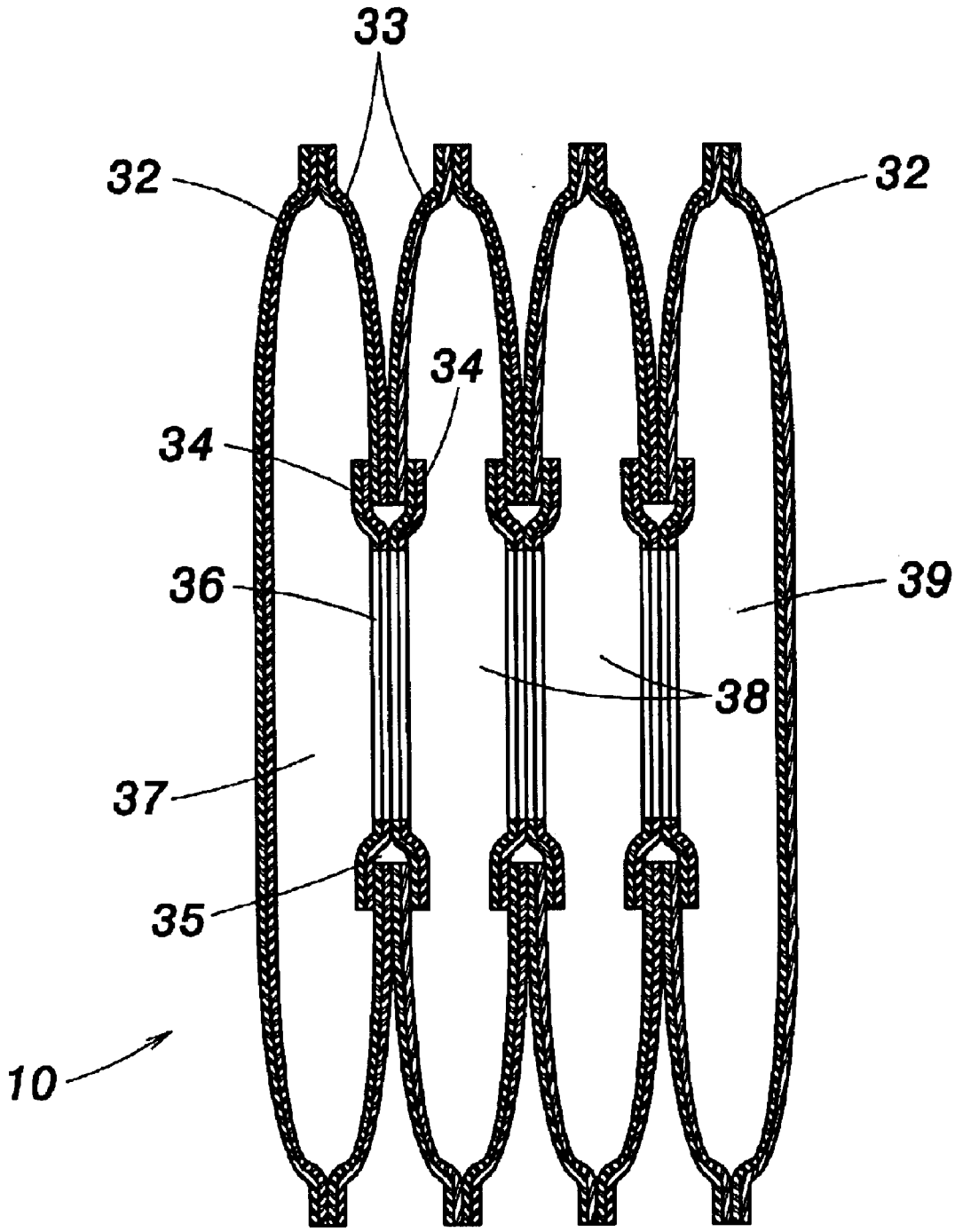
FIG. 5 is a side cross-sectional view of the air bag of the present invention.

As shown in FIGS. 3 to 5, the present invention provides a method for manufacturing an air bag placed in a printing cartridge. The method comprises the following step.

(1) A layered material 3 having double faces of different ingredients is provided;

One face of the layered material 3 adheres a low-melting-point ingredient 30 like polyethylene (PE), and the other face thereof adheres a high-melting-point ingredient 31 like polyethylene terephthalate (PET) or nylon;

(2) Membranes of appropriate size are cut;

The layered material 3 is cut to form side membranes 32;

The layered material 3 is cut to form folding membranes 33. The peripheral size of the folding membrane corresponds to that of the side membrane. A connection hole 35 is opened at the folding membrane 33;

The layered material 3 is cut to form connection membranes 34. The peripheral size of the connection membrane 34 is larger than the size of the connection hole 35 of the folding membrane 33. An air vent hole 36 is opened at the connection membrane 34. The size of the air vent hole 36 is smaller than that of the connection hole 35 of the folding membrane 33;

(3) The side membrane 32 is placed with the high-melting-point ingredient 31 (PET) facing downwards and the low-melting-point ingredient 30 (PE) facing upwards;

(4) One of the connection membranes 33 is placed with the high-melting-point ingredient 31 (PET) facing downwards and the low-melting-point ingredient 30 (PE) facing upwards;

(5) One of the folding membrane 33 is placed with the low-melting-point ingredient 30 (PE) facing downwards and the high-melting-point ingredient 31 (PET) facing upwards;

The periphery of the connection hole 35 of the folding membrane 33 is lapped at the periphery of the connection membrane 34. The periphery of the folding membrane 33 aligns with the periphery of the side membrane 32. A first receiving room 37 is thus formed.

(6) The other folding membrane 33 is placed with the high-melting-point ingredient 31 (PET) facing downwards and the low-melting-point ingredient 30 (PE) facing upwards;

This folding membrane 33 aligns with the preceding folding membrane 33. That is, periphery of the connection hole 35 of this folding membrane 33 aligns with the periphery of the connection hole 35 of the preceding folding membrane 33;

(7) The other connection membrane 34 is placed with the low-melting-point ingredient 30 (PE) facing downwards and the high-melting-point ingredient 31 (PET) facing upwards;

This connection membrane 34 aligns with the preceding connection membrane 34. That is, the periphery of this connection membrane 34 is lapped at the periphery of the connection hole 35 of the folding membrane 33, and the periphery of the air vent hole 36 of this connection membrane 34 is lapped at the periphery of the air vent hole 36 of the preceding connection membrane 34.

(8) Steps (4) and (5) are repeated once;

The connection membrane 34 aligns with the preceding connection membrane 34, and the folding membrane 33 aligns with the preceding folding membrane 33. Another receiving room 38 is thus formed;

(9) Steps (6) to (8) are repeated;

The folding membrane 33 aligns with the preceding folding membrane 33, and the connection membrane 34 aligns with the preceding connection membrane 33. Other receiving rooms 38 are thus formed;

(10) Steps (6) and (7) are repeated once;

The folding membrane 33 aligns with the preceding folding membrane 33, and the connection membrane 34 aligns with the preceding connection membrane 33;

(11) A side membrane is placed with the low-melting-point ingredient 30 (PE) facing downwards and the high-melting-point ingredient 31 (PET) facing upwards;

The periphery of the side membrane 32 aligns with the periphery of the folding membrane 33. A last receiving room 39 is thus formed;

(12) Thermal processing is performed to integrally form the whole air bag.

A thermal pressuring device 4 comprises an outer ring pressuring plane 40 and an inner ring pressuring plane 41. The outer ring pressuring plane 40 corresponds to the peripheries of the side membrane 32 and the folding membranes 33. The inner ring pressuring plane 41 corresponds to the periphery of the connection membranes 34. The whole air bag 10 is integrally formed by thermal pressuring once.

The thermal deformation temperature of the thermal pressuring process affixes the surfaces of two lapped low-melting-point gradients (30). The inner side surfaces of the first receiving room 37 and the last receiving room 39 of the peripheries of the side membranes 32 and the folding membrane 33 are fused together. The inner side surfaces of the receiving room 38 of the peripheries of two folding membranes 34 are fused together. The peripheries of the connection membrane 34 and the connection hole 35 of the folding membrane 33 are fused together. The air vent holes 36 of two connection membranes 34 adjacent to the receiving room 38 are fused together so that the receiving rooms 38 of the air bag 10 can have connected air vent holes 36 to achieve good strength and air tightness.

Because of the distinction between the low-melting-point ingredient 30 (PE) and the high-melting-point ingredient 31 (PET), thermal pressuring cannot affix the surfaces of two high-melting-point ingredients 31 (PET) or a high-melting-point ingredient 31 (PET) and a low-melting-point ingredient 30 (PE) together. For instance, the side membrane 32 and the connection membrane 34 cannot be fused together. The outer side surfaces of the receiving room 38 at the peripheries of the two folding membrane 33 cannot be fused together. Two connection membranes 34 of the same receiving room 38 cannot be fused together. Therefore, the air bag 10 can be folded up to make actions of inflation and deflation.

As shown in FIG. 5, the air bag 10 placed in the print cartridge 1 of the present invention comprises a side membrane 32, folding membranes 33, and connection membranes 34.

One face of the side membrane 32 adheres the low-melting-point ingredient 30 (PE), and the other face thereof adheres the high-melting-point ingredient 31 (PET or nylon).

One face of the folding membrane 33 adheres the low-melting-point ingredient 30 (PE), and the other face thereof adheres the high-melting-point ingredient 31 (PET or nylon). The peripheral size of the folding membrane 33 corresponds to that of the side membrane 32. The connection hole 35 is opened at the folding membrane 33.

One face of the connection membrane 34 adheres the low-melting-point ingredient 30 (PE), and the other face thereof adheres the high-melting-point ingredient 31 (PET or nylon). The peripheral size of the connection membrane 34 is larger than the size of the connection hole 35 of the folding membrane 33. The air vent hole 36 is opened at the connection membrane 34. The size of the air vent hole 36 is smaller than that of the connection hole 35 of the folding membrane 33.

The periphery of the low-melting-point ingredient 30 (PE) of the side membrane 32 is connected with the periphery of the low-melting-point ingredient 30 (PE) of the folding membrane 33 to form the first receiving room 37 and the last receiving room 39. The peripheries of the-low-melting-point ingredients 30 (PE) of two folding membranes 33 are connected together. The periphery of the low-melting-point ingredient 30 (PE) of the connection hole 35 of the folding membrane 33 and the periphery of the low-melting-point ingredient 30 (PE) of the connection membrane 34 are connected together. The peripheries of the low-melting-point ingredient 30 (PE) of the air vent hole 36 of two connection membranes 34 are connected together, thereby forming other receiving rooms 38 and having connected air vent holes 36. A folding type air bag 10 capable of making actions of inflation and deflation is thus formed.

Figure 6:
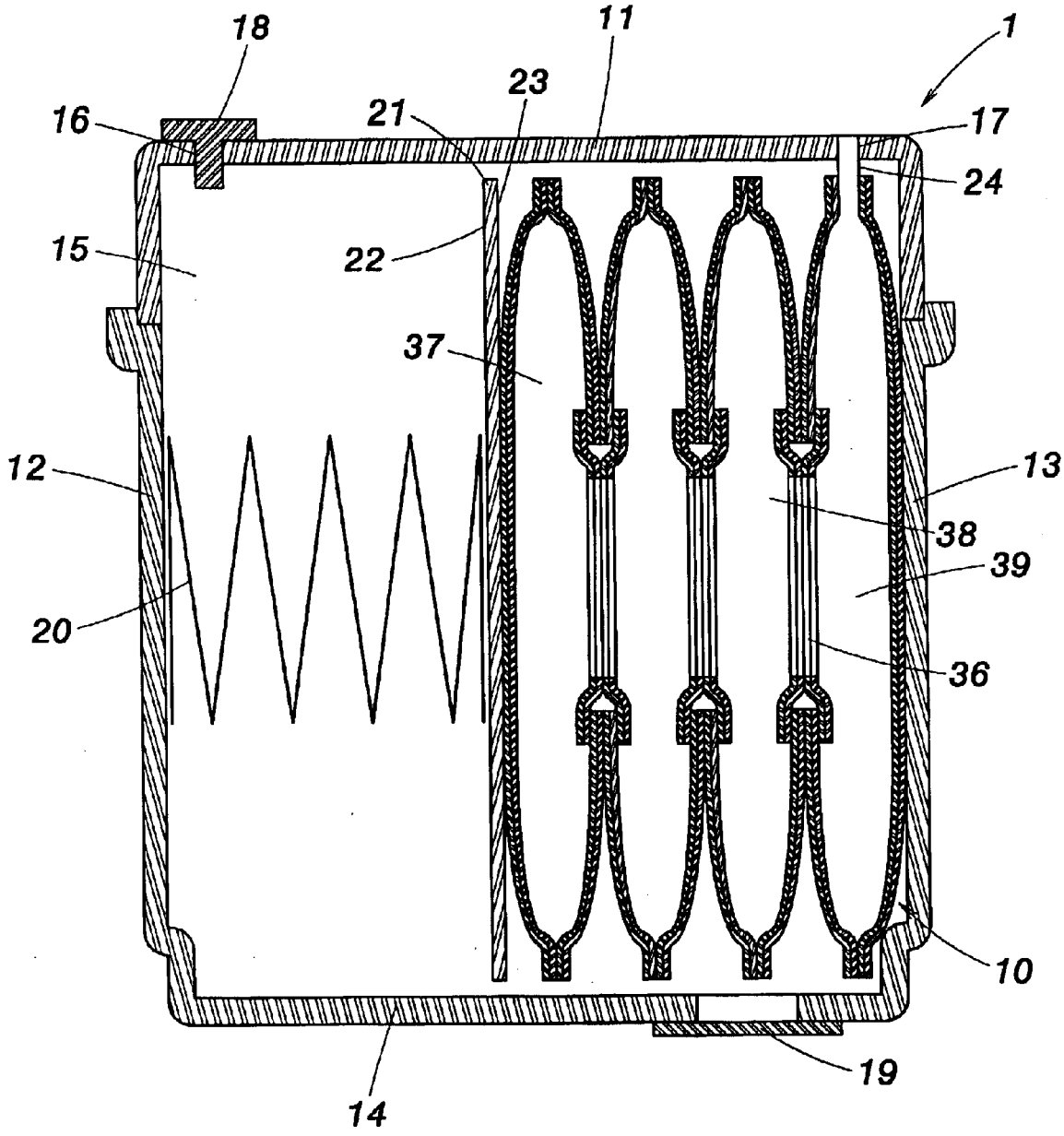
FIG. 6 is a side cross-sectional view of the air bag placed in a print cartridge according to a first embodiment of the present invention.

As shown in FIG. 6, the folding type air bag 10 is disposed in the print cartridge 1. The print cartridge 1 comprises an upper portion 11, a first sidewall 12, a second sidewall 13, and a bottom portion 14, which form an ink reservoir 15. Ink is received in the ink reservoir 15. The upper portion 11 has an ink-filling hole 16 and an air vent 17. The ink-filling hole 16 has a plug 18. The bottom portion 14 has a printing head 19. The ink reservoir 15 has an elastic component 20 and a pressing plate 21. The pressing plate 21 has a first surface 22 and a second surface 23. One end of the elastic component 20 is connected to the first sidewall 12, while the other end thereof is connected to the first surface 22 of the pressing plate 21. The second surface 23 of the pressing plate 21 contacts the outside of the first receiving room 37 of the air bag 10. The outside of the lasting receiving room 39 contacts the second sidewall 13. A guide pipe 24 is connected to the air vent 17 of the upper portion 11.

Figure 7:
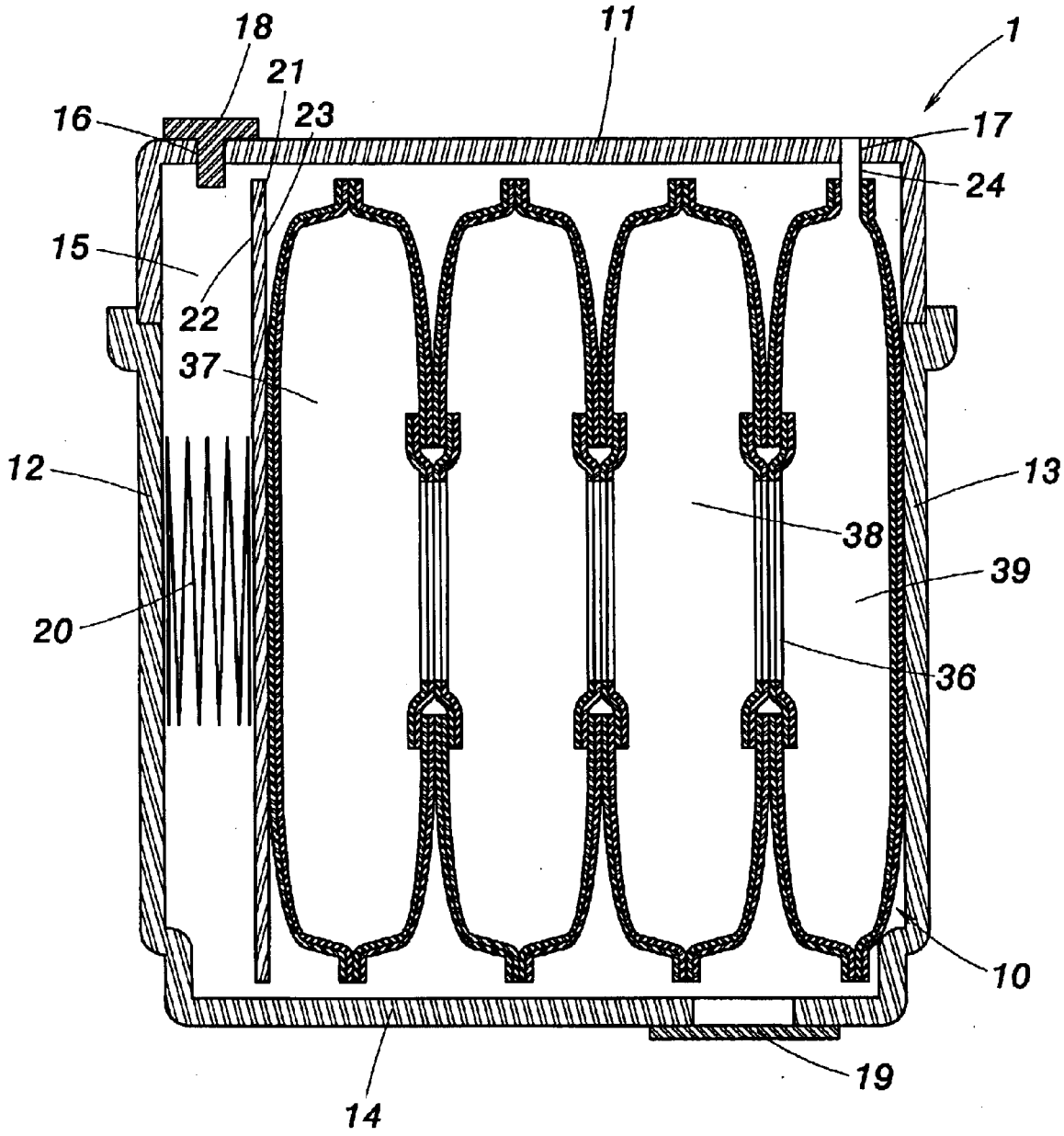
FIG. 7 is a side cross-sectional view of the air bag filling up the ink reservoir according to the first embodiment of the present invention.
Figure 8:
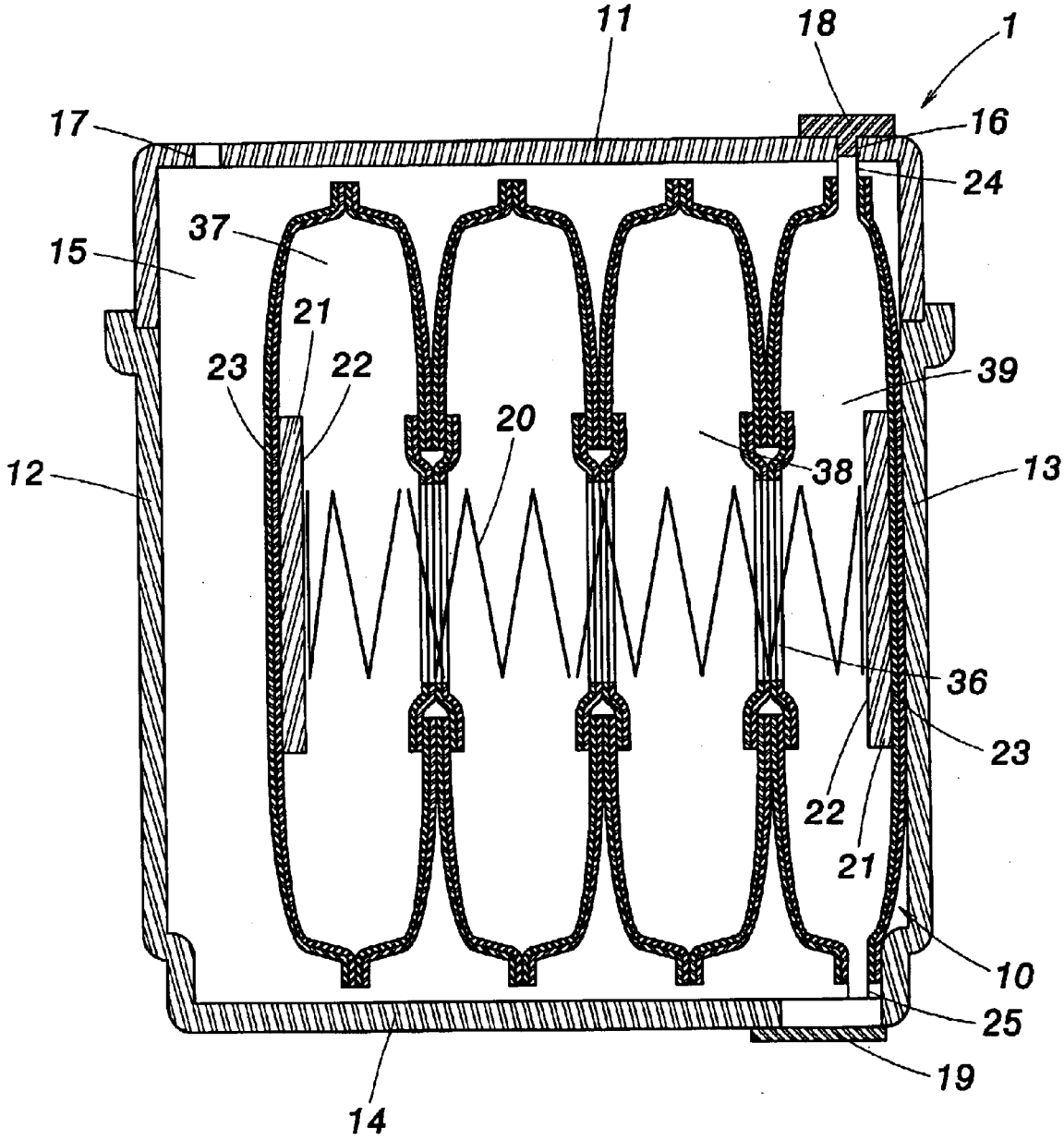
FIG. 8 is a side cross-sectional view of the air bag placed in a print cartridge according to a second embodiment of the present invention.

When ink is injected and the plug 18 is closed, the elastic component 20 will exert a force onto the air bag 10 to keep a back pressure so as to form an initial value of the back pressure in the print cartridge 1, hence avoiding leakage of ink. When the exterior pressure decreases, the elastic component 20 will exert a force onto the pressing plate 21 to push the air bag 10. The ink-storage capacity in the ink reservoir 15 thus increases to enlarge the back pressure so that the printing head 19 will have no ink leakage phenomenon. When ink goes out for printing, the back pressure rises, and the air bag 10 inflates to push the pressing plate 21 to press the elastic component 20 downwards, hence decreasing the ink storage capacity in the ink reservoir 15. The back pressure can thus be controlled within the range of ink-out pressure of the printing head 19 for normal ink-out actions. As shown in FIG. 7, when the air bag 10 arrives its maximum volume, the air bag 10 will almost fill up the ink reservoir 15 to reduce residual ink to minimum.

Moreover, there are four receiving rooms being formed in the embodiment just for explanation. In practice, the present invention also can be realized with two or more than two receiving rooms.

As shown in FIG. 3, the folding type air bag 10 is disposed in the print cartridge 1. The print cartridge 1 comprises an upper portion 11, a first sidewall 12, a second sidewall 13, and a bottom portion 14, which form an ink reservoir 15. Ink is received in the ink reservoir 15. The upper portion 11 has an ink-filling hole 16 and an air vent 17. The ink-filling hole 16 has a plug 18. The bottom portion 14 has a printing head 19. The ink receiving 15 has an elastic component 20 and two pressing plates 21. The pressing plate 21 has a first surface 22 and a second surface 23. Two ends of the elastic component 20 are connected to the first surfaces 22 of the two pressing plates 21, respectively. The two second surfaces 23 of the two pressing plates 21 contact insides of the first receiving room 37 and the last receiving room 39 of the air bag 10. Ink is received in the air bag 10. The ink reservoir 1 forms an air-storage capacity (i.e. an air tank), and the air bag 10 forms an ink-storage capacity (i.e. an ink-storage bag). The outside of the last receiving room 39 of the air bag 10 (i.e. the ink-storage bag) contacts the second sidewall 13. A guide pipe 24 is connected to the ink-filling hole 16 of the upper portion 11. An ink-out guide pipe 25 is connected to the printing head 19 at the bottom portion 14.

When ink is injected and the plug 18 is closed, ink fills up the air bag 10 (i.e. the ink-storage bag), and the air bag 10 (i.e. the ink-storage bag) almost fills up the ink reservoir 15 of the print cartridge 1 so as to form an initial value of the back pressure, hence avoiding leakage of ink. When the exterior pressure decreases, the elastic component 20 will exert a force onto the pressing plate 21*s* to lead the air bag 10 (i.e. the ink-storage bag) to inflate. The ink-storage capacity in the air bag 10 (i.e. the ink-storage bag) thus increases to enlarge the back pressure so that the printing head 19 will have no ink leakage phenomenon. When ink goes out for printing, the back pressure rises, and the air-storage capacity of the ink reservoir 15 (i.e. the air tank) increases to push the pressing plates 21 to press the elastic component 20 downwards, hence deflating the air bag 10 (i.e. the ink-storage bag) to decrease the ink-storage capacity in the air bag 10 (i.e. the ink-storage bag). The back pressure can thus be controlled within the range of ink-out pressure of the printing head 19 for normal ink-out actions. When ink in the air bag 10 almost runs out, air will fill up the ink reservoir 15 to shrink the air bag 10 to its smallest volume, hence reducing residual ink to minimum.

To sum up, the air bag placed in a print cartridge and a method for manufacturing the same of the present invention has the following characteristics.

(1) The foldable characteristic of the air bag forms a plurality of receiving rooms so that the air bag can fill up the ink-storage capacity in the print cartridge. Ink can thus be used up completely.

(2) Through the characteristic of two ingredients having different melting points at two faces of the layered material used by the air bag, the whole air bag can be integrally formed by thermal pressuring once, hence speeding up the manufacturing process, simplifying the components, and facilitating the design.

(3) The receiving rooms of the air bag are orderly and densely arranged so that the proceeding direction of the air bag can be easily controlled.

(4) Because the size of the periphery of the folding membranes of the air bag is small, no creases will be generated when the air bag inflates and then deflates. Therefore, the functions of other components in the print cartridge will not be easily influenced when the air bag inflates again.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

We claim:

1. A method for manufacturing an air bag placed in a print cartridge comprising the steps of:

(1) providing a layered material having two faces of different ingredients;

(2) placing a side membrane with a high-melting-point ingredient facing downwards and a low-melting-point ingredient facing upwards;

(3) placing a connection membrane with said high-melting-point ingredient facing downwards and said low-melting-point ingredient facing upwards;

(4) placing a folding membrane with said low-melting-point ingredient facing downwards and said high-melting-point ingredient facing upwards;

(5) placing a folding membrane with said high-melting-point ingredient facing downwards and said low-melting-point ingredient facing upwards;

(6) placing a connection membrane with said low-melting-point ingredient facing downwards and said high-melting-point ingredient facing upwards;

(7) placing a side membrane with said low-melting-point ingredient facing downwards and said high-melting-point ingredient facing upwards; and (8) performing thermal pressuring to integrally form the air bag.

2. The method for manufacturing an air bag placed in a print cartridge as claimed in claim 1, wherein, in said step (1), one face of said layered material adheres said low-melting-point ingredient, and the other face thereof adheres said high-melting-point ingredient.

3. The method for manufacturing an air bag placed in a print cartridge as claimed in claim 2, wherein, in said step (1), said low-melting-point ingredient is polyethylene, and said high-melting-point ingredient is polyethylene terephthalate.

4. The method for manufacturing an air bag placed in a print cartridge as claimed in claim 2, wherein, in said step (1), said low-melting-point ingredient is polyethylene, and said high-melting-point ingredient is nylon.

5. The method for manufacturing an air bag placed in a print cartridge as claimed in claim 1, wherein a step for cutting membranes of appropriate size is added between said step (1) and (2).

6. The method for manufacturing an air bag placed in a print cartridge as claimed in claim 5, wherein said layered material is first cut to form side membranes and then cut to form folding membranes, the peripheral size of said folding membrane corresponds to that of said side membrane, a connection hole is opened at said folding membrane, said layered material is subsequently cut to form connection membranes, the peripheral size of said connection membrane is larger than the size of said connection hole of said folding membrane, an air vent hole is opened at said connection membrane, and the size of said air vent hole is smaller than the size of said connection hold of said folding membrane.

7. The method of manufacturing an air bag placed in a print cartridge as claimed in claim 6, wherein, in said step (4), the periphery of said connection hole of said forming membrane is lapped at the periphery of said connection membrane, and the periphery of said folding membrane aligns with the periphery of said side membrane.

8. The method for manufacturing an air bag placed in a print cartridge as claimed in claim 7, wherein said folding membrane in said step (5) aligns with the preceding folding membrane.

9. The method for manufacturing an air bag placed in a print cartridge as claimed in claim 8, wherein said connection membrane in said step (6) aligns with the preceding connection membrane.

10. The method for manufacturing an air bag placed in a print cartridge as claimed in claim 9, wherein, in said step (7), the periphery of said side membrane aligns with the periphery of said folding membrane.

11. An air bag placed in a print cartridge, said air bag comprising:

side membranes whose one face adhering a low-melting-point ingredient and whose other face adhering a high-melting-point ingredient;

folding membranes whose one face adhering said low-melting-point ingredient and whose other face adhering said high-melting-point ingredient, the peripheral size of said folding membrane corresponding to that of said side membrane, a connection hole being opened at said folding membrane; and connection membranes whose one face adhering said low-melting-point ingredient and whose other face adhering said high-melting-point ingredient, the peripheral size of said connection membrane being larger than the size of said connection hole of said folding membrane, an air vent hole being opened at said connection membrane;

whereby the periphery of said low-melting-point ingredient of said side membrane connects the periphery of said low-melting-point ingredient of said folding membrane to form a first receiving room and a last receiving room, the peripheries of said low-melting-point ingredient of two said folding membranes are connected together, the periphery of said low-melting-point ingredient of said connection hole of said facing membrane connects the periphery of said low-melting-point ingredient of said connection membrane, the peripheries of said low-melting-point ingredient of said air vent holes of two said folding membranes are connected together to form other receiving rooms having connected air vent holes, a folding type air bag capable of inflating and deflating is thus formed.

12. The air bag placed in the print cartridge as claimed in claim 11, said print cartridge comprising an upper portion, a first sidewall, a second sidewall, and a bottom portion, which form an ink reservoir, said upper portion having an ink-filling hole and an air vent, said ink-filling hole having a plug, said bottom portion having a printing head, ink being received in said ink reservoir.

13. The air bag placed in the print cartridge as claimed in claim 11, wherein said low-melting-point ingredient is polyethylene, while said high-melting-point ingredient is polyethylene terephthalate.

14. The air bag placed in the print cartridge as claimed in claim 11, wherein said low-melting-point ingredient is polyethylene, while said high-melting-point ingredient is nylon.

15. The air bag placed in the print cartridge as claimed in claim 11, wherein said ink reservoir has an elastic component and a pressing plate, said pressing plate has a first surface and a second surface, one end of said elastic component is connected to said first sidewall, the other end thereof is connected to said first surface of said pressing plate, said second surface of said pressing plate contacts an outside of said first receiving room of said air bag, said air bag has also a guide pipe connected to said air vent of said upper portion.

16. An air bag placed in a print cartridge, said air bag comprising:

side membranes whose one facing adhering a low-melting-point ingredient and whose other face adhering a high-melting-point ingredient;

folding membranes whose one face adhering said low-melting-point ingredient and whose other face adhering said high-melting-point ingredient, the peripheral size of said folding membrane corresponding to that of said side membrane, a connection hole being opened at said folding membrane; and connection membranes whose one face adhering said low-melting-point ingredient and whose other face adhering said high-melting-point ingredient, the peripheral size of said connection membrane being larger than the size of said connection hole of said folding membrane, an air vent hole being opened at said connection membrane;

whereby the periphery of said low-melting-point ingredient of said side membrane connects the periphery of said low-melting-point ingredient of said folding membrane to form a first receiving room and a last receiving room, the peripheries of said low-melting-point ingredient of two said folding membranes are connected together, the periphery of said low-melting-point ingredient of said connection hole of said folding membrane connects the periphery of said low-melting-point ingredient of said connection membrane, the peripheries of said low-melting-point ingredient of said air vent holes of two said folding membranes are connected together to form other receiving rooms having connected air vent holes, a folding type air bag capable of inflating and deflating is thus formed, ink is received in said air bag.

17. The air bag placed in the print cartridge as claimed in claim 16, said print cartridge comprising an upper portion, a first sidewall, a second sidewall, and a bottom portion, which forms an ink reservoir, said upper portion having an ink-filling hole and an air vent, said ink-filling hole having a plug, said bottom portion having a printing head.

18. The air bag placed in the print cartridge as claimed in claim 16, wherein said low-melting-point ingredient is polyethylene, while said high-melting-point ingredient is polyethylene terephthalate.

19. The air bag placed in the print cartridge as claimed in claim 16, wherein said low-melting-point ingredient is polyethylene, while said high-melting-point ingredient is nylon.

20. The air bag placed in the print cartridge as claimed in claim 16, wherein said ink reservoir has an elastic component and two pressing plates, said pressing plate has a first surface and a second surface, two ends of said elastic component are connected to said first surfaces of said two pressing plates, respectively, said second surfaces of said two pressing plates contact insides of said first receiving room and said last receiving room of said air bag, said ink reservoir forms an air-storage capacity while said air bag forms an ink-storage capacity, a guide pipe is connected to said ink-filling hole of said upper portion, and an ink-out guide pipe is connected to said printing head of said bottom portion.

* * * * *